US007473144B2

(12) United States Patent
Kemper

(10) Patent No.: US 7,473,144 B2
(45) Date of Patent: Jan. 6, 2009

(54) MULTIPORT ETHERNET CONNECTOR

(75) Inventor: Curt Kemper, Salem, OR (US)

(73) Assignee: Intel Corporation, Santa Clara, CA (US)

( * ) Notice: Subject to any disclaimer, the term of this patent is extended or adjusted under 35 U.S.C. 154(b) by 36 days.

(21) Appl. No.: 11/553,733

(22) Filed: Oct. 27, 2006

(65) Prior Publication Data

US 2008/0102709 A1 May 1, 2008

(51) Int. Cl.
*H01R 24/00* (2006.01)

(52) U.S. Cl. ..... 439/676

(58) Field of Classification Search ..... 439/676
See application file for complete search history.

(56) References Cited

U.S. PATENT DOCUMENTS 5,178,554 A * 1/1993 Siemon et al. ..... 439/676
6,250,964 B1 * 6/2001 Fair et al. ..... 439/607
6,413,120 B1 * 7/2002 Winings et al. ..... 439/676
6,419,526 B1 * 7/2002 Fair et al. ..... 439/676
6,761,585 B2 * 7/2004 Clark et al. ..... 439/540.1

* cited by examiner

*Primary Examiner*—Briggitte R Hammond
(74) *Attorney, Agent, or Firm*—Grossman, Tucker, Perreault & Pfleger PLLC

(57) ABSTRACT

A circuit card assembly such as an Ethernet card may comprise at least three ports disposed along a longitudinal axis of a faceplate wherein each port is orientated in a different direction with respect to an adjacent port. The ports may include an orientator configured to align a plug in a predetermined direction with respect to the port. The orientators may be disposed in a different direction with respect to a plug orientator of an adjacent port. Additionally, the mechanical connector of a first port may be partially supported by an adjacent port and, as a result, the spacing between adjacent ports may be minimized.

18 Claims, 7 Drawing Sheets

MULTIPORT ETHERNET CONNECTOR

FIELD

The present disclosure relates generally to systems for Ethernet connectors, and more particularly multiport Ethernet cards.

BACKGROUND INFORMATION

Many computer and electronics systems include removable and/or replaceable circuit boards. Such removable circuit boards may, for example, be in the form of computer blades, cards, etc. A typical removable circuit board or add-in card may include an Ethernet card having a faceplate coupled to a printed circuit board as well as connections (for example, mechanical and/or electrical connections) to allow the card to interact with other circuitry and/or systems (not shown) disposed within computer or electronic system. A port or jack (for example, an RJ45 jack/port) may be secured to the faceplate using a mechanical fastener and acts as a physical interface between the card and another device (typically a cable such as, but not limited to, twisted pair type cables).

A single card may include multiple RJ45 jacks which are generally oriented in the same direction such that all of the notched regions or pins of the RJ45 jacks are all arranged in the same direction. Unfortunately, this arrangement may make it difficult to identify a specific cable plug and/or RJ45 jack from others on the multi-port card. Additionally, the mechanical connector(s for each RJ45 jack may require a minimum amount of space between adjacent RJ45 jacks to provide support for the mechanical connector(s) thus the maximum number of RJ45 jacks that can be placed on a faceplate may be limited. Moreover, the number of RJ45 jacks that can be fit on a faceplate may be further reduced in order for the card to comply with applicable IEEE specifications such as, but not limited to, IEEE 802.3 Ethernet.

Accordingly, there exists a need for an improved multi-port card that obviates or reduces some of these drawbacks. It is important to note that the present disclosure is not intended to be limited to a system or method which must satisfy one or more of any stated objects or features of the invention. It is also important to note that the present disclosure is not limited to the preferred, exemplary, or primary embodiment(s) described herein. Modifications and substitutions by one of ordinary skill in the art are considered to be within the scope of the present disclosure, which is not to be limited except by the following claims.

BRIEF DESCRIPTION OF THE DRAWINGS

Features and advantages of the claimed subject matter will be apparent from the following detailed description of embodiments consistent therewith, which description should be considered with reference to the accompanying drawings, in which:

DETAILED DESCRIPTION

Consistent with the present disclosure, various embodiments of circuit board assemblies are shown in FIGS. 1-6 comprising a plurality of input/output (I/O) interfaces or ports 28 orientated along a longitudinal axis L of a faceplate 24 and/or circuit board 22 in different directions with respect to adjacent ports 28.

Figure 1:
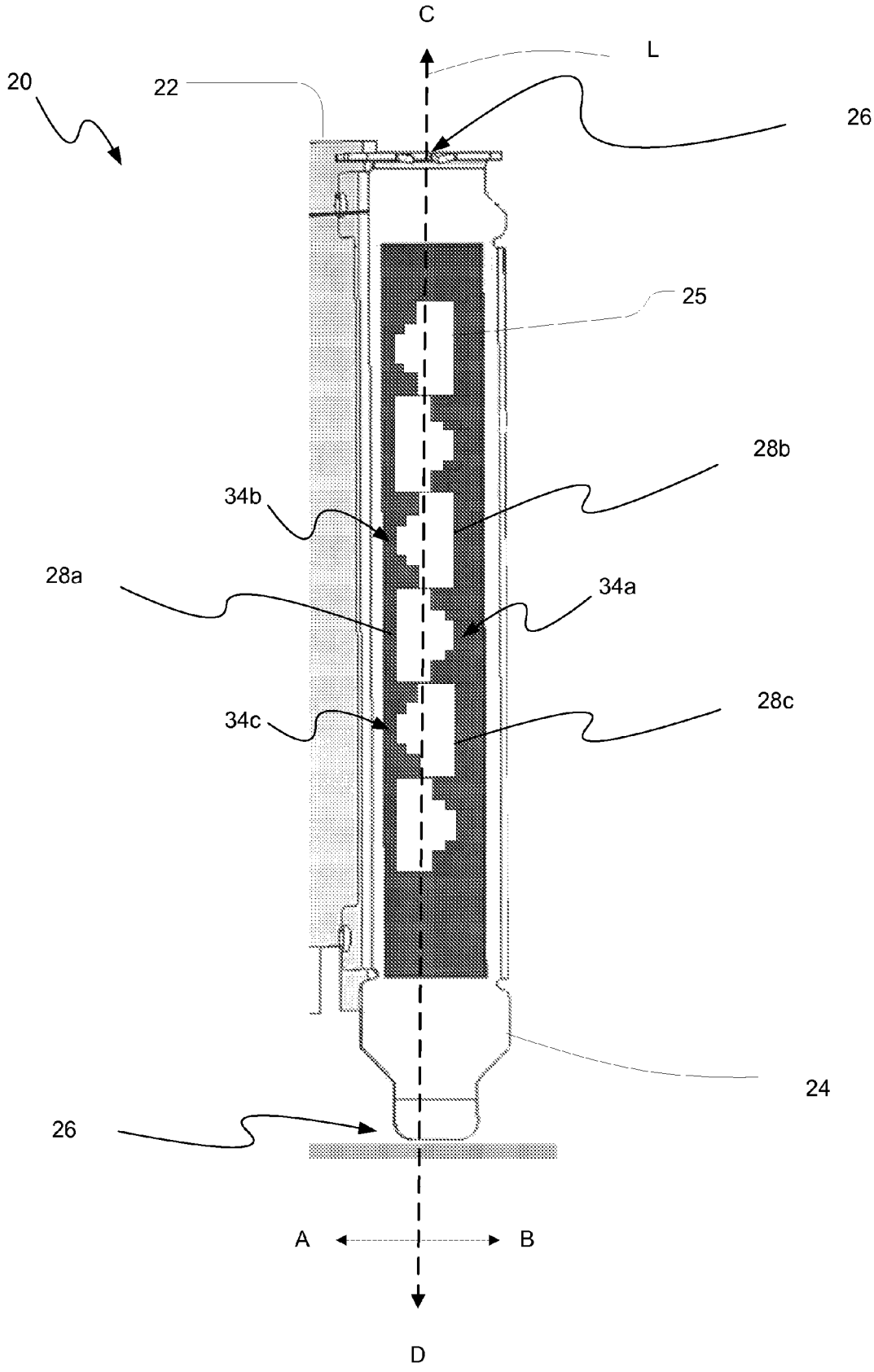
FIG. 1 is an end perspective view of one embodiment of a circuit board assembly according to the present disclosure.
Figure 2:
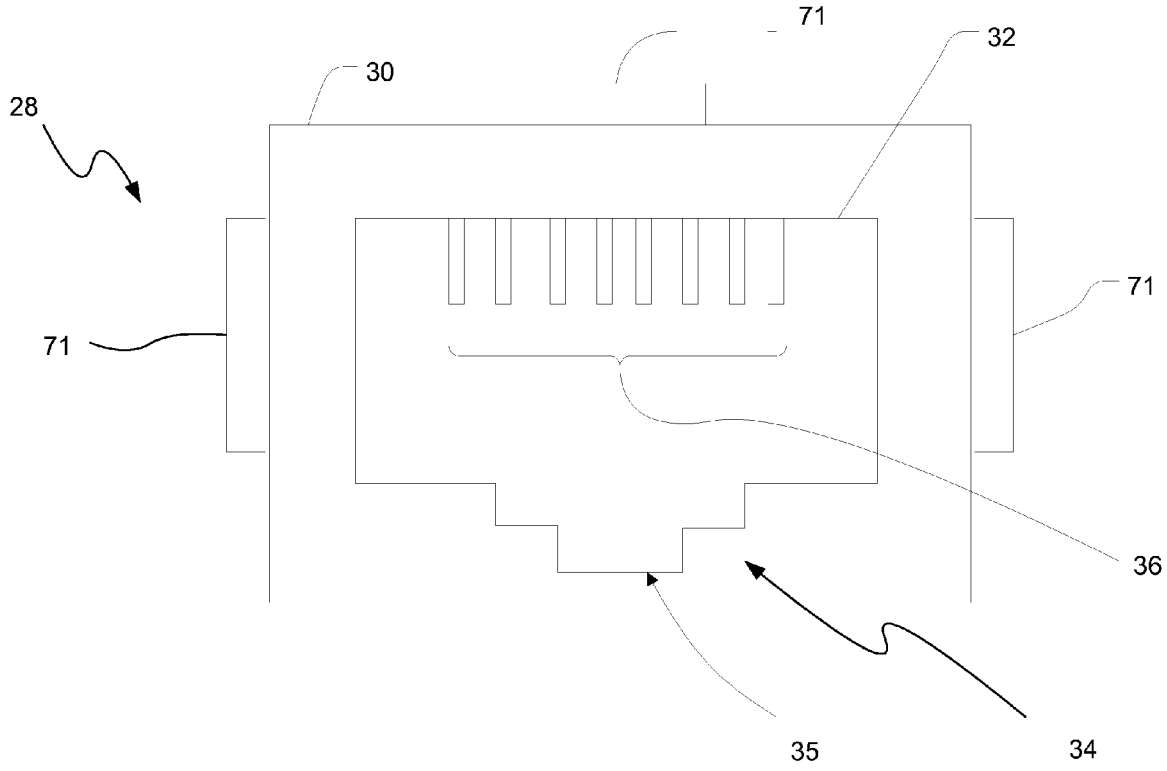
FIG. 2 is a front plan view of one embodiment of an input/output interface according to the present disclosure.

With reference to FIG. 1, one embodiment of a circuit board assembly 20 according to the present disclosure is shown. The circuit board assembly 20 may include two or more ports 28 which may be electrically and/or mechanically coupled to the circuit board 22 and/or the faceplate 24. Each port 28, FIG. 2, may include a body portion or housing 30 defining at least one cavity 32 and may include one or more mechanical connectors 71 configured to secure the port 28 to the faceplate 24 and/or circuit board 22. The mechanical connectors 71 may include any device known to those skilled in the art for connecting the port 28 to the faceplate 24 including, but not limited to, a biased latch or tab, protrusion, aperture, or the like. The cavity 32 may be sized and shaped to accept a cable plug (not shown) such that the plug may be electrically coupled to the pins 36 of the port 28. According to one embodiment, the pins 36 may be arranged about a region of an interior surface of the cavity 32 that is generally opposite from a notched region 34, however, the pins 36 may be located elsewhere.

The port 28 may also include a plug orientator 35 that is configured to engage with the cable plug and to orientate the cable plug relative to the port 28, and specifically the pins 36. The plug orientator 35 may include any device known to those skilled in the art for creating the proper orientation of the cable plug relative to the port 28 such as, but not limited to, a peg, post, or a "lock and key" shape. One example of a "lock and key" shape includes the notched region 34 described above. For sake of clarity, the term plug orientator 35 will generally be interchangeable with the notched region 34; however, this is not a limitation of the present disclosure unless specifically claimed as such. The plug orientator 35 may also form a mechanical connection with the cable plug. For example, the plug orientator 35 may engage with a biased tab or latch disposed on the cable plug. Consistent with any embodiment described herein, the port 28 may include an RJ45 port or an RJ11 port.

Referring back to FIG. 1, the ports 28 may be arranged about the circuit board assembly 20 such that the orientation of the plug orientators 35 of the ports 28 alternates along the longitudinal axis L of the faceplate 24. In the following description, the terms "left" and "right" refer to opposite sides of the circuit board assembly 20 along the longitudinal axis L of the circuit board assembly 20 indicated by arrows A and B when the circuit board assembly 20 is seen from the front (i.e., when the circuit board assembly 20 is installed in the chassis). The terms "top" and "bottom" refer to opposite ends of faceplate 24 along the longitudinal axis L indicated by C and D. The faceplate 24 may also include one or more apertures or openings 25 through which the cavities 32 of the ports 28 accessed.

For example, the notched region 34*a* of a first port 28*a* may be orientated substantially towards the right while the notched region 34*b* and/or 34*c* of an adjacent port 28*b* and/or 28*c* may be orientated towards the left. Of course, those skilled in the art will readily recognize that the first port 28*a* may alternatively be orientated towards the left while the adjacent port(s) 28*a,b* may be orientated towards the right.

The circuit board assembly 20 may feature additional ports 28 along the longitudinal axis L configured to have their orientations alternate with respect to the adjacent ports 28.

Figure 3:
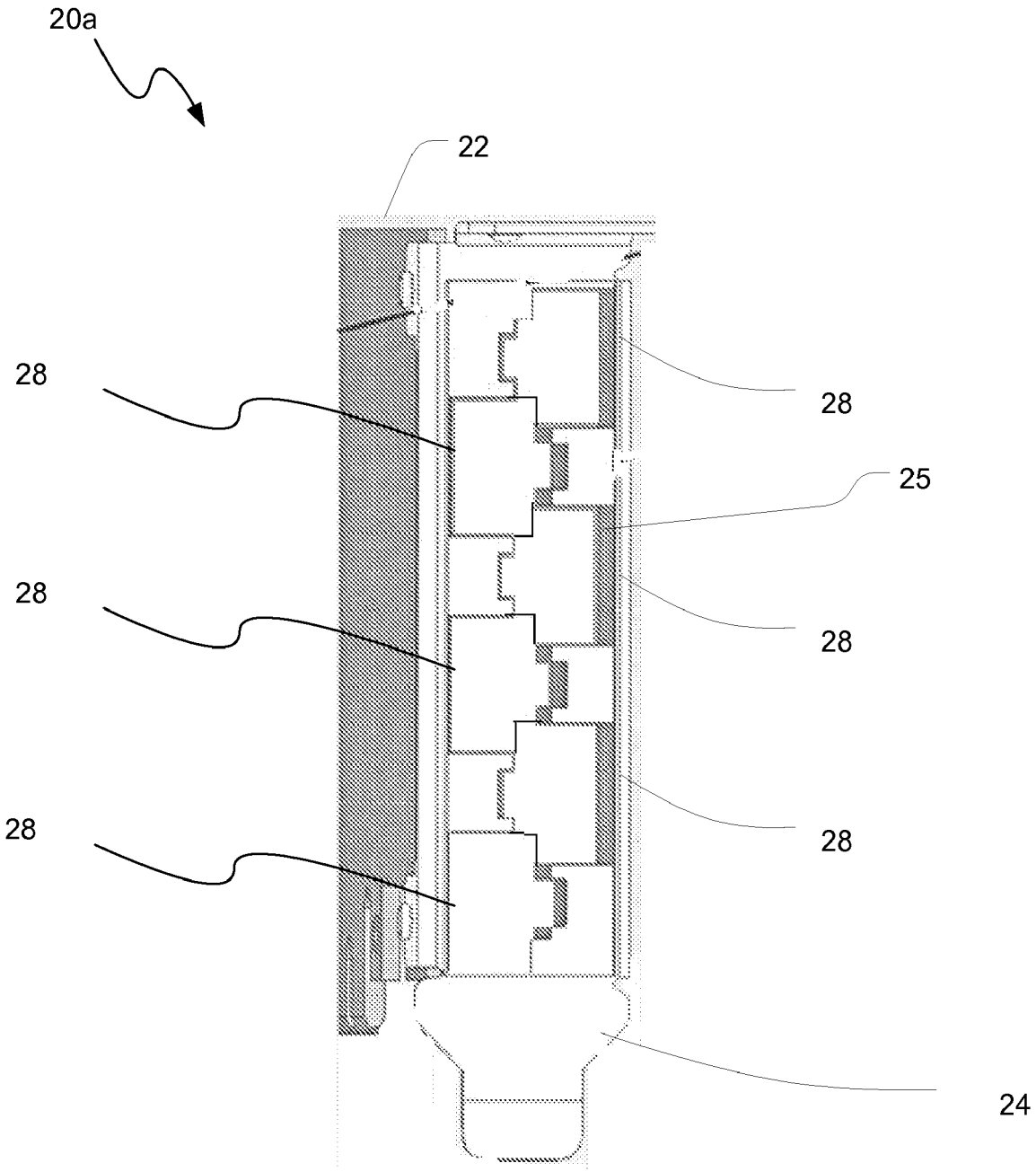
FIG. 3 is an end perspective view of one embodiment of a low-profile circuit board assembly according to the present disclosure.

According to various other embodiments consistent with the present disclosure, the circuit board assembly 20 may include a traditional, full-height/profile circuit board assembly 20 as shown in FIG. 1, a low-profile circuit board assembly 20*a* as shown in FIG. 3, or a custom profile circuit board assembly. For illustrative purposes only, a full-profile circuit board assembly 20, FIG. 1, has been created according to the present disclosure having six ports 28 as well as seven ports 28. Additionally, a low profile circuit board assembly 20*a*, FIG. 3, has been created according to the present disclosure having four ports 28.

By alternating the orientation of the ports 28 along the length of the longitudinal axis L of the circuit board assembly 20, two or more ports 28 may be disposed within a common aperture 25 in the faceplate 24 and may provide mechanical/physical support to each other. As a result, the space between adjacent ports may be minimized and/or eliminated and the circuit board assembly 20 according to the present disclosure may be provided with additional ports 28 compared to other multiport card designs having the same dimensions. Additionally, the alternating orientation of the ports 28 of the present disclosure facilitates distinguishing and identifying a specific port 28 and/or a cable connected to the port 28.

The alternating orientation of the ports 28 also facilitates removal of the cable plugs from the ports 28. As discussed above, the ports 28 may include a notched region 34 within the cavity 32 that is configured to engage with the cable plug to form a mechanical connection with the cable plug. While not a limitation of the present disclosure, a biased tab disposed on the cable plug may engage the notched region 34 of the cavity 32 to create the mechanical connection between the cable plug and the port 28. To disconnect the cable plug from the port 28, the biased tab is urged away from the notched region 34 and the cable plug may then be removed from the port 28. Those skilled in the art will readily recognize, however, that other devices for creating the mechanical connection between the port 28 and the cable plug are possible and the present disclosure is not limited to any specific mechanical connection unless specifically claimed as such. The alternating orientation of the ports 28 according to the present disclosure may increase the amount of space available to a user when accessing the biased tab of the cable plug since the notched regions 24 of the adjacent ports 28 (and therefore the biased tabs of the adjacent cable plugs) may be facing in the substantially opposite direction.

Figure 4:
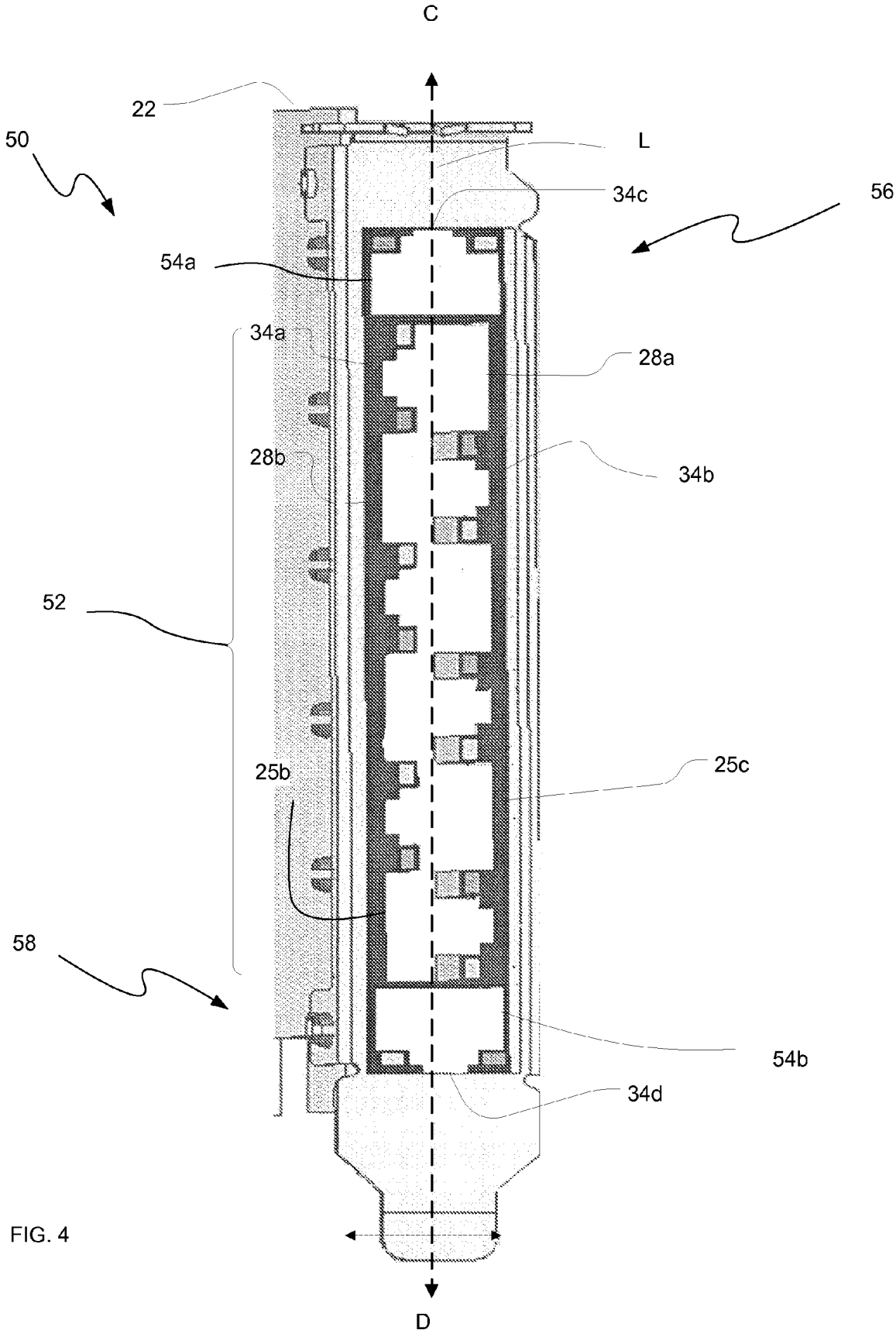
FIG. 4 is an end perspective view of another embodiment of a circuit board assembly according to the present disclosure.

Another embodiment of a circuit board assembly 50 is shown in FIG. 4 consistent with the present disclosure. The circuit board assembly 50 may include one or more ports 28 orientated such that the notched regions 34 alternate left and/or right as described above. The faceplate 24 may also include one or more apertures 25*c* through which the port(s) 28 of the region 52 may be disposed. The circuit board assembly 50 may also include one or more ports 54 having notched regions 34 orientated substantially parallel to the length of the longitudinal axis L and the faceplate 25 may include apertures 24*a,b* sized and shaped to accept the ports 54. For example, the circuit board assembly 50 may include a first port 54*a* disposed proximate a first end region 56 having a notched region 34*c* orientated substantially towards the top C of the faceplate 24 and/or a second port 54*b* disposed proximate a second end region 58 having a notched region 34*d* orientated substantially towards the bottom D of the faceplate 24.

The ports 54 orientated parallel to the longitudinal axis L may further increase the port capacity of the circuit board assembly 50. Additionally, the orientation of the ports 52, 54 may also further differentiate the ports 52, 54 from each other, thereby facilitating the identification of an individual port 52, 54 from the remaining ports 52, 54 on the circuit board assembly 50. Moreover, the orientation of the port(s) 54 may also facilitate access to and removal/installation of the cable plug by providing increased access to the biased tab of the cable plug. For illustrative purposes only, a circuit board assembly 50 has been made having up to eight ports 52, 54 on a full-height circuit board assembly 50.

Figure 5:
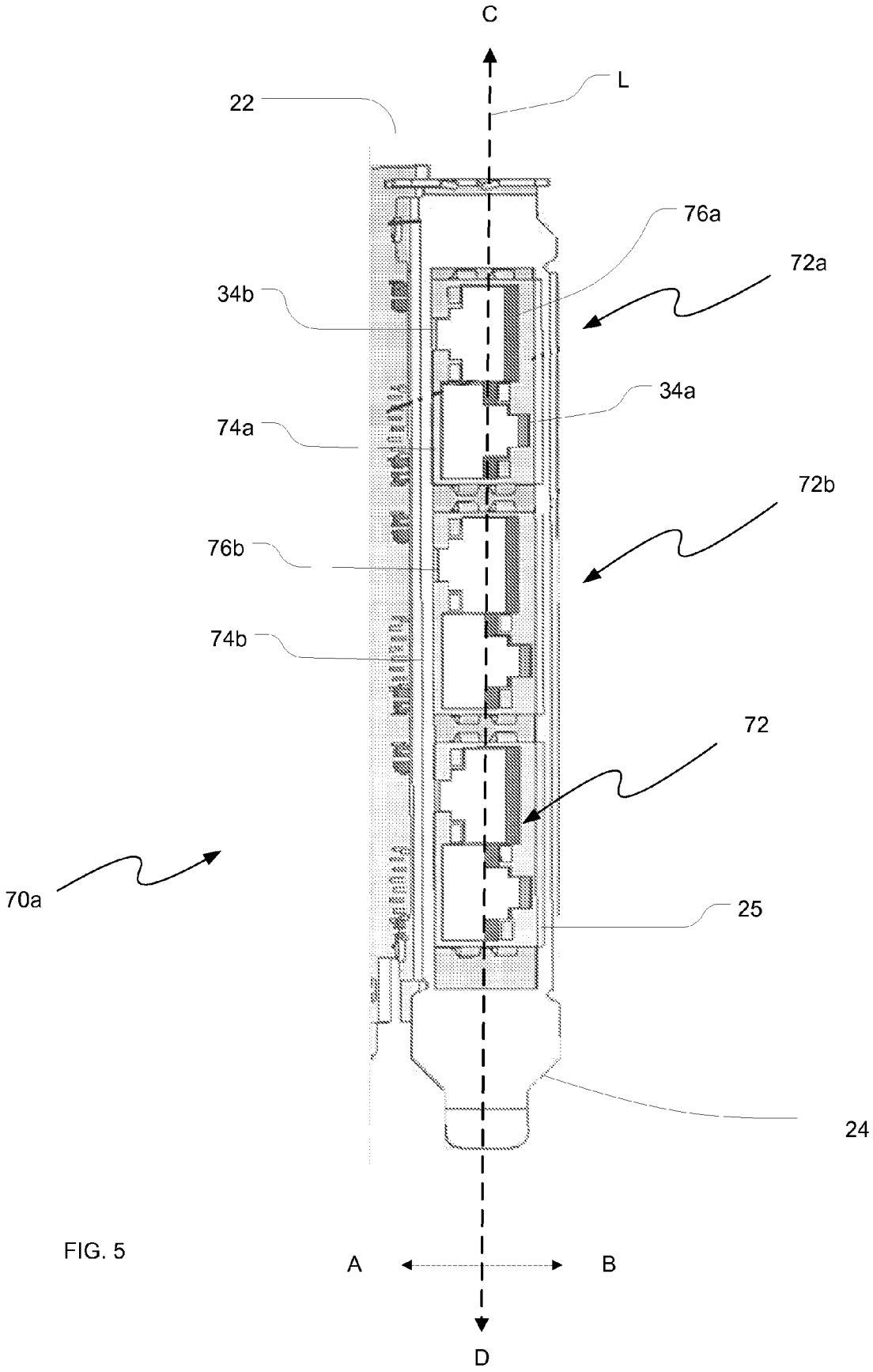
FIG. 5 is an end perspective view of one embodiment of a dual port circuit board assembly according to the present disclosure.
Figure 6:
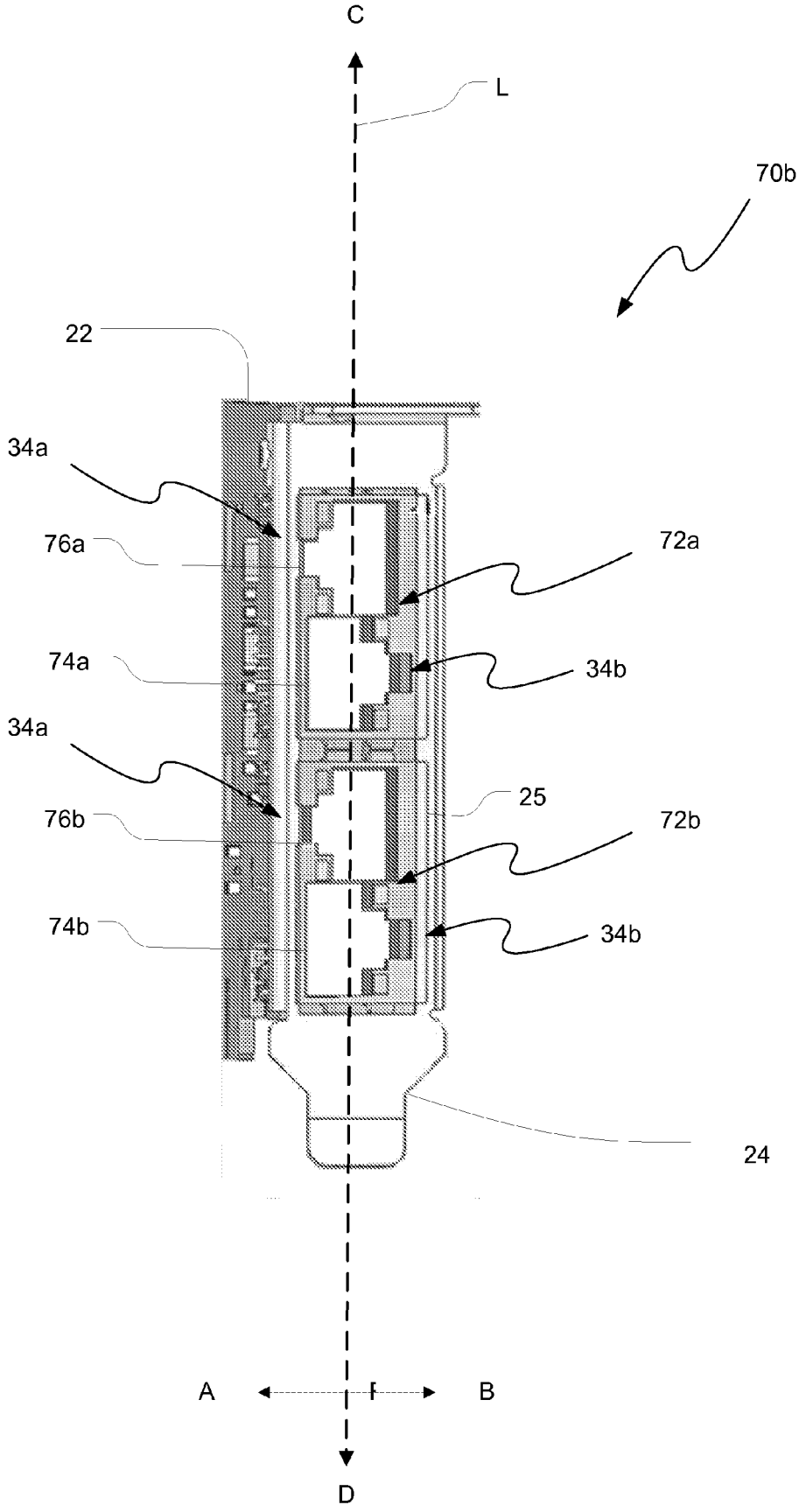
FIG. 6 is an end perspective view of one embodiment of a dual port, low-profile circuit board assembly according to the present disclosure.

Another embodiment of a circuit board assembly 70 consistent with the present disclosure is shown in FIGS. 5 and 6. The circuit board assembly 70 may include either a full-height circuit board assembly 70*a* as shown in FIG. 5, a low profile circuit board assembly 70*b* as shown in FIG. 6, or a custom height circuit board assembly. The circuit board assembly 70 may feature one or more dual port connectors 72 each having two ports 74, 76 with notched regions 34*a,b* orientated in different directions from each other (for example, either left and right or up and down). According to one embodiment, a first a second dual port connector 72*a*, 72*b* may be orientated such that the adjacent ports 74*a*, 76*b* on each dual port connector 72*a*, 72*b* are arranged in different or alternating directions. For illustrative purposes only, a full-height circuit board assembly 70*a*, FIG. 5, has been made having up to three dual port connectors 72 (for a total of six ports 74, 76) and two dual port connectors 72 on a low-profile circuit board assembly 70*b*, FIG. 6, for a total of four ports 74, 76.

Consistent with any embodiment described herein, the faceplate 24 may extend along at least a portion of one edge of the circuit board 22. The circuit board 22 and the faceplate 24 may both be provided as separate components that may be assembled, attached, and/or coupled to one another, either directly or indirectly such that the circuit board 22 and the faceplate 24 may be installed and/or removed from the chassis as a single piece. Alternatively, the circuit board 22 and the faceplate 24 may be provided as a single component of unitary construction.

Figure 7:
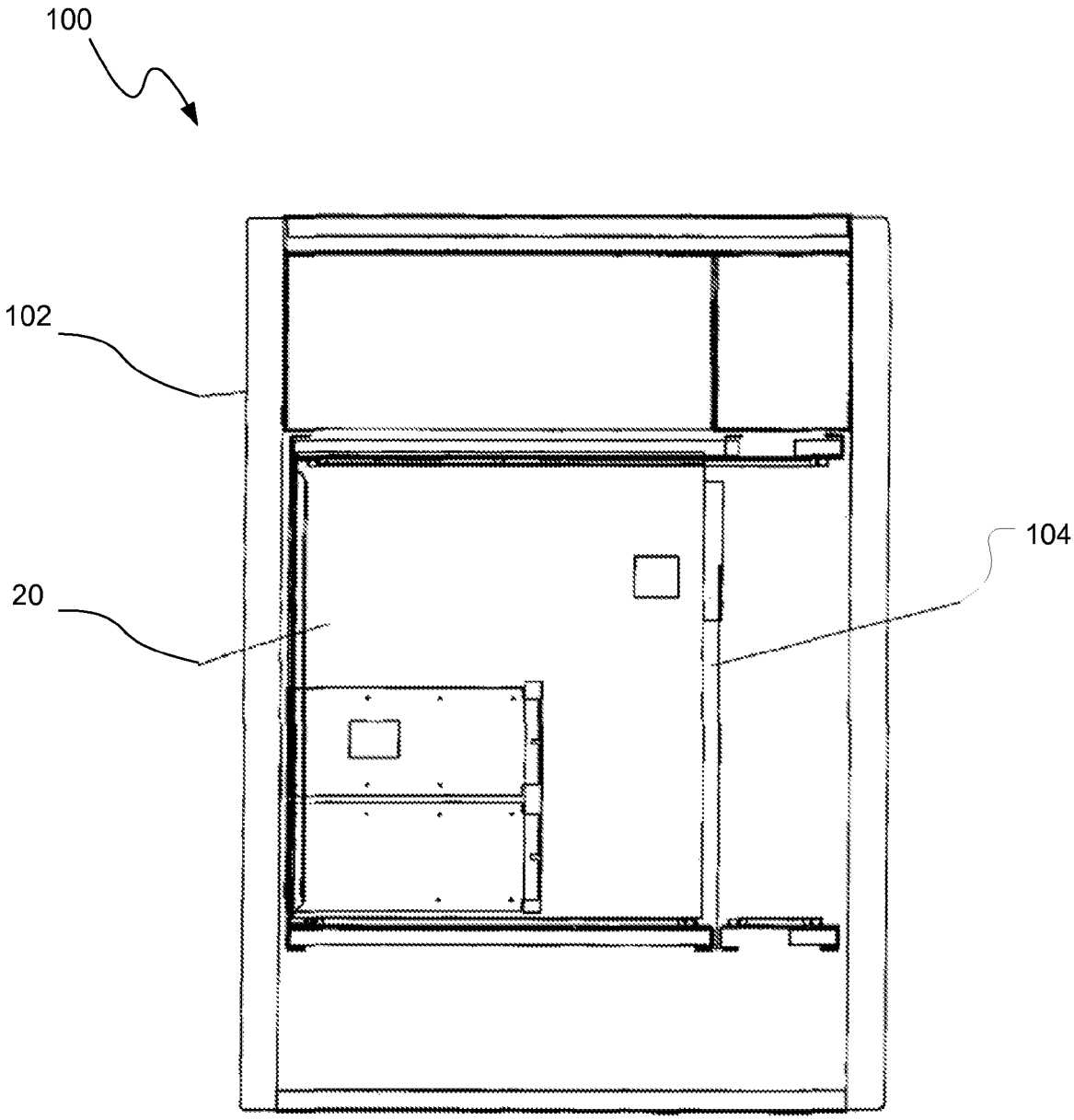
FIG. 7 is a top perspective view of one embodiment of a computer system according to the present disclosure.

According to one embodiment, the faceplate 24 may be oriented generally perpendicular to the circuit board 22. One side of the faceplate 24 may face generally away or outwardly relative to the circuit board 22, and another side of the faceplate 24 may face generally inwardly relative to the circuit board 22. The faceplate 24 may include a fastening system 26 configured to releasably electrically and/or mechanically couple the circuit board assembly 20 to a chassis 102, FIG. 7, and/or one or more additional circuit boards, features, backplanes 104, and/or components disposed at least partially within the chassis 102 of a computer system 100. The fastening system 26 may include any device for securing the faceplate 24 to the chassis 102 known to those skilled in the art including, but not limited to, one or more latches, tabs, screws, apertures, clips, or the like.

According to one embodiment the chassis 102 may be an advanced telecommunications computing architecture (advanced TCA or ATCA) chassis, complying with, or compatible with, PCI Industrial Computer Manufacturers Group (PICMG), Advanced Telecommunications Computing Architecture (ATCA), PICMG 3.0 Rev. 1.0, published Dec. 30, 2002. According to such an embodiment, the circuit board assembly 20 disposed within the chassis 102 may be an ATCA board, also referred to as an ATCA blade. According to various other embodiments consistent with the present disclosure, the system may be any electronics system including at least one circuit board assembly 120 that is capable of being at least partially removed or uncoupled from the chassis 102.

As mentioned above, the present disclosure is not intended to be limited to a system or method which must satisfy one or more of any stated or implied object or feature of the invention and should not be limited to the preferred, exemplary, or primary embodiment(s) described herein. The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the claims when interpreted in accordance with breadth to which they are fairly, legally and equitably entitled.

The invention claimed is:

1. A system comprising:
a frame comprising at least one chassis; and
a circuit board assembly configured to be coupled to said chassis, said circuit board assembly comprising:
a circuit board;

a faceplate configured to be secured to a circuit board; and a first, a second, and at least third port each comprising:
a cavity configured to accept a plug;

a plurality of pins disposed within said cavity; and an orientator configured to accept said plug in a predefined orientation with respect to said port, wherein each of said orientators are disposed in a different direction with respect to an orientator of an adjacent port, wherein said orientator of said first port is aligned in a first direction substantially perpendicular to a longitudinal axis of said faceplate, said orientator of said second port is aligned in a second direction substantially perpendicular to said longitudinal axis and substantially opposite said first direction, and said orientator of said third port is aligned in a third direction substantially parallel to said longitudinal axis.

2. The system of claim 1 wherein said orientators comprise a notched region.

3. The system of claim 2 wherein each of said ports comprise an RJ45 port.

4. The system of claim 3 further comprising:
a first dual port connector comprising said first port disposed adjacent to said second port; and
a second dual port connector comprising said third port disposed adjacent to a fourth port.

5. The system of claim 4 wherein said third port is disposed proximate a first end region of said faceplate.

6. The system of claim 5 further comprising a fourth port disposed proximate a second end region of said faceplate, wherein an orientator of said fourth port is aligned in a fourth direction substantially parallel to said longitudinal axis and substantially opposite said third direction.

7. The system of claim 1 wherein each port further comprises a mechanical connector configured to secure said port to said faceplate.

8. The system of claim 7 wherein said first port at least partially supports said mechanical connector of said second, adjacent port.

9. The system of claim 8 wherein said faceplate is not disposed between an interface of said first and said second ports.

10. An apparatus comprising:
a faceplate; and
a first, a second, and at least third port disposed along a longitudinal axis of said faceplate, each port comprising:
a cavity configured to accept a plug,
a plurality of pins disposed within said cavity; and
an orientator configured to accept said plug in a predefined orientation with respect to said plurality of pins, wherein each of orientators are disposed in a different direction with respect to an orientator of an adjacent port, wherein said orientator of said first port is aligned in a first direction substantially perpendicular to said longitudinal axis of said faceplate, said orientator of said second port is aligned in a second direction substantially perpendicular to said longitudinal axis and substantially opposite of said first direction, and said orientator of said third port is aligned in a third direction substantially parallel to said longitudinal axis.

11. The apparatus of claim 10 wherein said orientators comprise a notched region.

12. The apparatus of claim 11 wherein each of said ports comprise an RJ45 port.

13. The apparatus of claim 10 wherein each port comprises a mechanical connector configured to secure said port to said faceplate.

14. The apparatus of claim 13 wherein said first port at least partially supports said mechanical connector of said second, adjacent port.

15. The apparatus of claim 10 further comprising:
a first dual port connector comprising said first port disposed adjacent to said second port; and
a second dual port connector comprising said third port disposed adjacent to a fourth port.

16. The apparatus of claim 15 wherein said third port is disposed proximate a first end region of said faceplate.

17. The apparatus of claim 16 further comprising a fourth port disposed proximate a second end region of said faceplate, wherein an orientator of said fourth port is aligned in a fourth direction substantially parallel to said longitudinal axis and substantially opposite said third direction.

18. An apparatus comprising:
a circuit board; and
a first, a second, and a third port disposed along a longitudinal axis of a faceplate coupled to said circuit board, each port comprising:
a cavity;
a plurality of pins disposed within said cavity; and
an orientator configured to accept a plug in a predefined orientation with respect to said plurality of pins wherein said first and said third ports are adjacent to said second port and wherein said orientator of said second port is disposed in a different direction with respect to said orientators of said first and said third ports, wherein said orientator of said first port is aligned in a first direction substantially perpendicular to the longitudinal axis of said faceplate, said orientator of said second port is aligned in a second direction substantially perpendicular to said longitudinal axis and substantially opposite of said first direction, and said orientator of said third port is aligned in a third direction substantially parallel to said longitudinal axis.

* * * * *